US008628223B2

(12) United States Patent
Kwok et al.

(10) Patent No.: US 8,628,223 B2
(45) Date of Patent: Jan. 14, 2014

(54) IMITATION CANDLE

(75) Inventors: Ho Chung Kwok, Chaiwan (HK); Chi Kwan Mok, Chaiwan (HK)

(73) Assignee: Concept Bright (HK) Limited, Chaiwan (HK)

( * ) Notice: Subject to any disclaimer, the term of this patent is extended or adjusted under 35 U.S.C. 154(b) by 157 days.

(21) Appl. No.: 13/299,814

(22) Filed: Nov. 18, 2011

(65) Prior Publication Data

US 2013/0050985 A1 Feb. 28, 2013

(30) Foreign Application Priority Data

Aug. 29, 2011 (CN) ..... 2011 1 0249808
Nov. 4, 2011 (EP) ..... 11187965

(51) Int. Cl.
*F21V 21/14* (2006.01)
*F21V 35/00* (2006.01)

(52) U.S. Cl.
USPC ..... 362/392; 362/96; 362/393; 362/253; 439/123

(58) Field of Classification Search
USPC ..... 362/96, 392, 393, 806, 810, 234, 253; 439/123, 124
See application file for complete search history.

(56) References Cited

U.S. PATENT DOCUMENTS

| | | | | |
|---|---|---|---|---|
| 6,454,425 | B1 | 9/2002 | Lin | 362/96 |
| 6,554,443 | B2 * | 4/2003 | Fan | 362/96 |
| 6,616,308 | B2 | 9/2003 | Jensen et al. | 362/351 |
| 6,966,665 | B2 * | 11/2005 | Limburg et al. | 362/96 |
| 7,093,949 | B2 * | 8/2006 | Hart et al. | 362/96 |
| 7,159,994 | B2 | 1/2007 | Schnuckle et al. | 362/161 |
| 7,837,355 | B2 | 11/2010 | Schnuckle | 362/249.02 |
| 8,132,936 | B2 | 3/2012 | Patton et al. | 362/249.02 |
| 2002/0141189 | A1 * | 10/2002 | Lin | 362/294 |
| 2004/0257798 | A1 * | 12/2004 | Hart et al. | 362/96 |
| 2007/0115663 | A1 | 5/2007 | Weiser et al. | 362/253 |
| 2012/0134157 | A1 | 5/2012 | Li | 362/277 |

FOREIGN PATENT DOCUMENTS

| | | |
|---|---|---|
| CN | 2783116 | 5/2006 |
| CN | 2906310 | 5/2007 |
| CN | 201069056 | 6/2008 |
| CN | 101865413 | 10/2010 |
| CN | 201599578 | 10/2010 |

(Continued)

OTHER PUBLICATIONS

Chinese Search Report for CN 201110249808X, Jun. 26, 2012.

(Continued)

*Primary Examiner* — Bao Q Truong
(74) *Attorney, Agent, or Firm* — Kusner & Jaffe

(57) ABSTRACT

The present invention relates to an imitation candle, comprising a housing, an imitation flame body provided at a top of the housing, a light source adapted to emit light onto the imitation flame body, a swing motion device, and an air blowing device. A lower portion of the imitation flame body is connected with the swing motion device that is configured to allow the imitation flame body to pivot horizontally about at least one of a X axis and a Y axis, and comprises a wind driven pendulum member. The air blowing device is adapted to blow air toward the wind driven pendulum member causing the wind driven pendulum member to swing as well as the imitation flame body to pivot. The wind driven pendulum member is a wind driven bowl adapted to receive blowing air and having an air discharge hole.

15 Claims, 9 Drawing Sheets

(56) References Cited

FOREIGN PATENT DOCUMENTS

| | | |
|---|---|---|
| CN | 202215951 | 5/2012 |
| EP | 2 565 518 A1 | 3/2013 |
| HK | 1147019 | 7/2011 |

OTHER PUBLICATIONS

Chinese Examination Report for CN 201110249808X, Jul. 4, 2012.

Extended European Search Report for corresponding European Patent Application No. 11187965.6, Nov. 21, 2012.

* cited by examiner

IMITATION CANDLE

FIELD OF THE INVENTION

The present invention relates to the technical field of consumer electronic product, in particular to an imitation candle.

BACKGROUND OF THE INVENTION

Traditional candles are mainly used for illumination or in special occasions for enhancing atmosphere. The use of candles is easily affected and restricted by the environments as naked flame is used, for instance, the candle is easily extinguished if it is used in a strong wind environment, and naked flame combustion in a closed room consumes oxygen, produces harmful waste gases, and makes people feel discomfortable. Moreover, there are potential safety hazards such as fire disaster if the candle is loosely fixed at bottom or flammable material comes close to the flame. As a result, the traditional candles are gradually replaced by imitation candles.

With the continuous development of the electric power, the candles are less used for illumination in daily life, but currently primarily used for enhancing atmosphere. Consequently, higher requirements are demanded for the imitation or simulation of the candles.

Many imitation or simulation candles had been proposed.

Chinese utility model patent No. 201020114356.5 discloses an electronic imitation candle lamp for fete, comprising a pedestal, a candle body and a flame device, wherein a concave cavity is provided in the center of the pedestal, a battery groove is provided in the cavity for placing batteries, a shielding cover is provided at a mouth of the cavity of the pedestal for covering the whole surface of the cavity, and the center of the shielding cover is fixedly connected with the candle body, a fan is installed in an inner chamber of the candle body, the flame device that consists of a fixed board, a flame sheet and an LED light-emitting diode is arranged on an upper end of the candle body, and the LED light-emitting diode and the fan are connected with a power supply in the pedestal via wirings to form a power supply loop. The flame portion of the imitation candle as disclosed uses the flame sheet that has a high imitation and can be driven to swing by the fan.

Other mechanical candles that use air blowing device are described in U.S. Pat. No. 6,454,425 and U.S. Pat. No. 1,824,388.

In U.S. Pat. No. 7,837,355, a kinetic flame device is disclosed that includes a housing with two stages of magnetic coupling of pendulum members, and a flame silhouette element is caused to move by electromagnetic force interacting between magnets on the pendulum members.

In U.S. Pat. No. 7,159,994, a mounting system is disclosed that provides a flame shaped diffuser to have a rotary motion about two axes.

There is a continuous demand for novel and or improved imitation or simulation candles.

SUMMARY OF THE INVENTION

An object of the present invention is to provide a novel and or improved imitation or simulation candle that would meet the consumer demand in the market.

In accordance with a first aspect of the present invention, there is provided an imitation candle, comprising a housing, an imitation flame body provided at a top of the housing, a light source adapted to emit light onto the imitation flame body, a swing motion device, and an air blowing device. A lower portion of the imitation flame body is connected with the swing motion device that is configured to allow the imitation flame body to pivot horizontally about at least one of a X axis and a Y axis, and comprises a wind driven pendulum member, and the air blowing device is adapted to blow air toward the wind driven pendulum member causing the wind driven pendulum member to swing as well as the imitation flame body to pivot.

Conveniently, the wind driven pendulum member is a wind driven bowl adapted to receive blowing air, and the wind driven bowl has an air discharge hole that may be provided with an air discharge direction guide, preferably in the form of a hood attached to outside the wind driven bowl.

Further, the wind driven pendulum member may be fixedly connected to a lower portion of a swing rod, and an upper portion of the swing rod may be fixedly connected to the lower portion of the imitation flame body.

Separately, the swing motion device comprises a swing driving unit and a passive swing unit. The swing driving unit is operationally coupled to the passive swing unit, wherein the swing driving unit comprises the wind driven pendulum member and the passive swing unit comprises at least one of a X pivot shaft and a Y pivot shaft arranged horizontally and perpendicular to each other such that the imitation flame body is allowed to pivot horizontally about at least one of the X axis and the Y axis.

In accordance with an aspect of the present invention, the imitation candle may further comprise an annular top cover, a swing rod, a pivot member, and a pivot support member. The configuration of the imitation candle is that the annular top cover is provided at the top of the housing, the lower portion of the imitation flame body extends through the annular top cover and is fixedly connected to an upper portion of the swing rod, a swing rod pivot hole is provided at the upper portion of the swing rod, the X pivot shaft runs through the swing rod pivot hole to be pivotally connected with the pivot member, the pivot support member is provided outside the pivot member, the pivot member and the pivot support member are pivotally connected via the Y pivot shaft provided inside the pivot support member, the pivot member is correspondingly provided with pivot holes for the Y pivot shaft, the X pivot shaft and the Y pivot shaft are arranged on the same horizontal plane, and the swing driving unit is provided at a lower portion of the swing rod.

Conveniently, a pivot ball is provided at a top of the swing rod, and the swing rod pivot hole runs through the pivot ball. Further, the annular top cover is provided with a light penetrating hole for the light source, and preferably, a light focusing cover is fitted over the light source.

In practice, the air blowing device would be a fan provided below the wind driven bowl, and an air outlet of the fan is positioned rightly opposite the wind driven bowl.

In one embodiment, the imitation flame body is recessed to one side.

In a preferred embodiment, a microprocessor circuit board and a power supply are provided inside the housing, and the microprocessor circuit board is adapted to control intensity of light from the light source and intensity of air from the air blowing device.

Conveniently, the power supply is a battery unit provided at a bottom of the housing, and a slide power on/off switch is provided in a circuitry of the power supply. Additionally, the imitation candle further comprises a sound control power off switch operable by a user blowing air toward the imitation flame body. Further, a fragrance box may also be provided inside the housing.

The beneficial effects of the present invention would be generally understood and appreciated in the detailed description of the embodiments below.

BRIEF DESCRIPTION OF THE DRAWINGS

The present invention will be further described with reference to the accompanying drawings, while the contents in the accompanying drawings will not limit the inventive aspect of the present invention.

Figure 1:
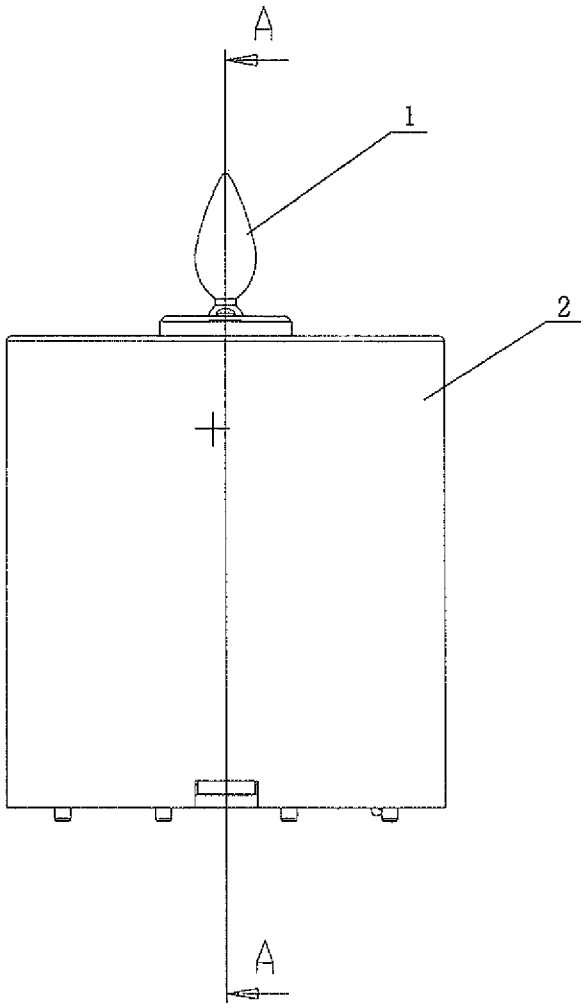
FIG. 1 is a structure schematic view of an embodiment of an imitation candle according to the present invention.
Figure 2:
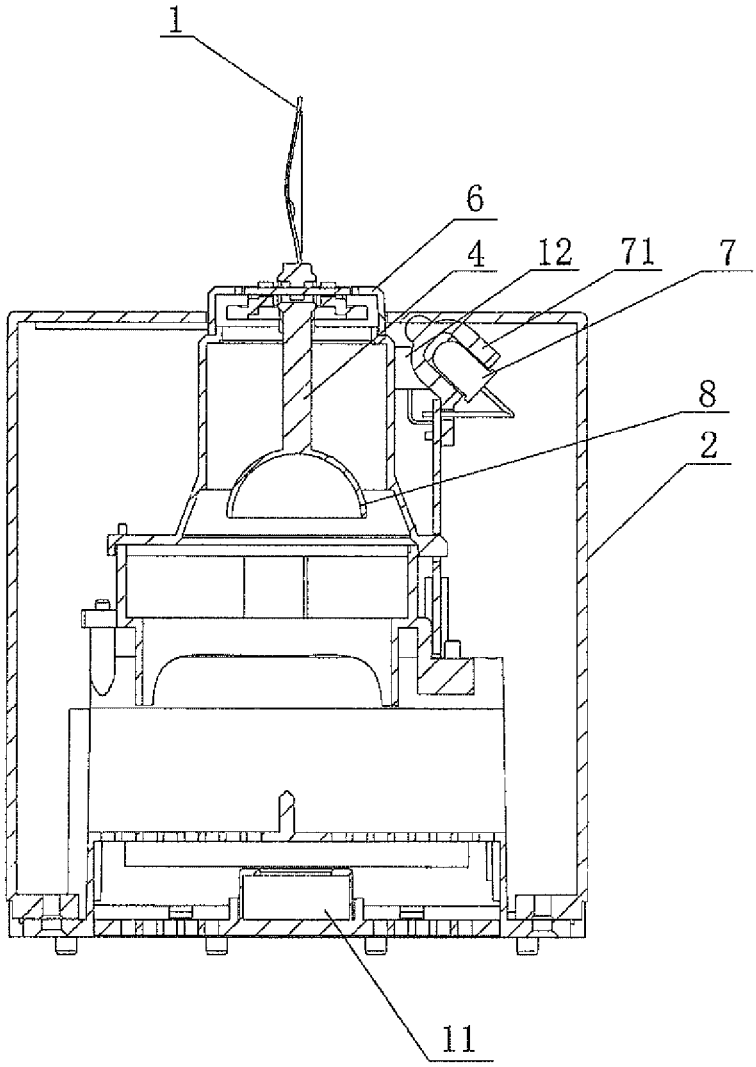
FIG. 2 is a sectional structure schematic view of the embodiment of an imitation candle according to the present invention along line A-A of FIG. 1.
Figure 3:
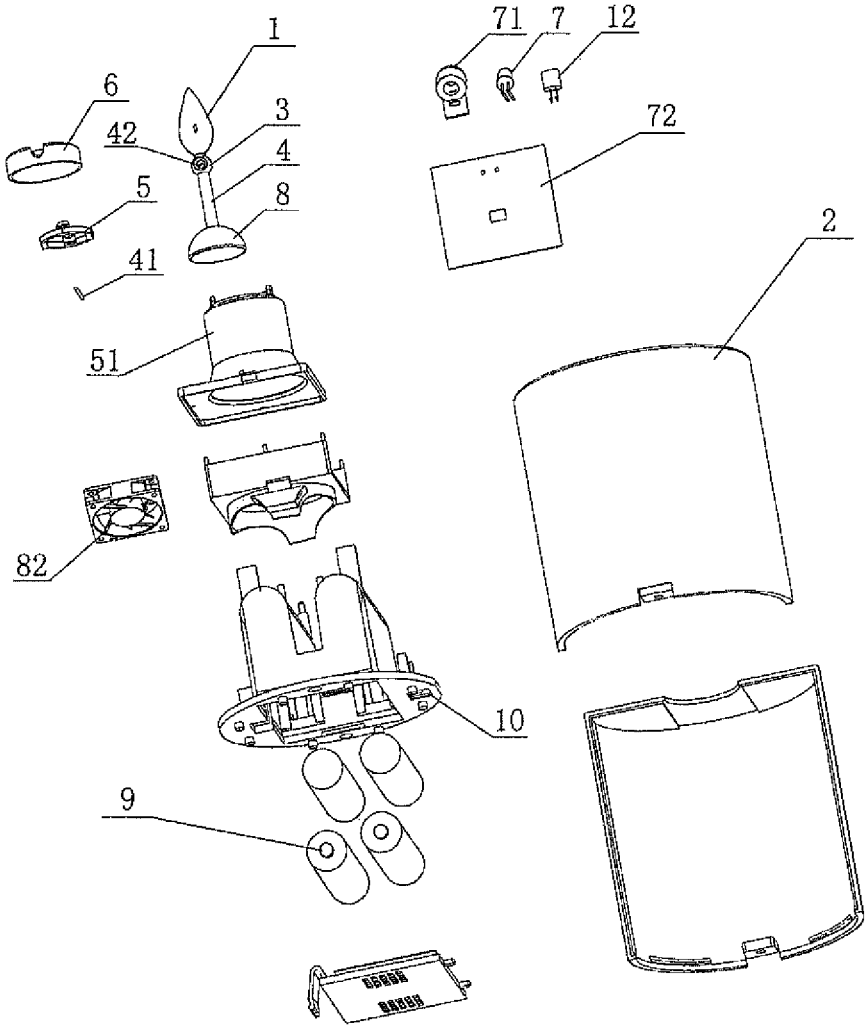
FIG. 3 is an exploded schematic view of the embodiment of an imitation candle according to the present invention.

The reference numbers in FIGS. 1 to 7 include:

1 an imitation flame body,
2 a housing,
3 a pivot ball,
4 a swing rod,
5 a pivot member,
6 an annular top cover,
7 an LED light source,
8 a wind driven bowl,
9 a power supply,
10 a slide switch,
11 a fragrance box,
12 a capacitive sound pickup.
41 a X pivot shaft,
42 a swing rod pivot hole,
51 a pivot support member,
52 a Y pivot shaft,
53 a pivot hole,
71 a light focusing cover,
72 a microprocessor circuit board,
80 an air discharge direction hood,
81 an air discharge hole,
82 a fan,

DETAILED DESCRIPTION OF THE EMBODIMENTS

The present invention will be further described in connection with the embodiments shown in the accompanying drawings.

In one aspect, as shown in FIGS. 1 to 7, an imitation candle comprises a housing 2, a circuit provided inside the housing 2, an imitation flame body 1 provided at a top of the housing 2 and a power supply 9 at a bottom thereof. The housing may be an imitation housing made from a plurality of materials such as paraffin wax, plastics or other materials looking like paraffin wax.

A lower portion of the imitation flame body 1 is connected with a swing motion device that comprises a swing driving unit and a passive swing unit. The passive swing unit comprises an X pivot shaft 41 and a Y pivot shaft 52 which are arranged horizontally and perpendicular to each other and which allow the imitation flame body 1 to pivot or swing. Both the power supply 9 and the swing motion device are arranged inside the housing 2.

The X pivot shaft 41 and the Y pivot shaft 52 assure the imitation flame body of the imitation candle to be capable of swinging at least in two directions, enhancing the stereoscopic impression of the imitation flame of the imitation candle. The passive swing unit is driven by the swing driving unit to swing within 360°, bringing the imitation flame body 1 to swing within 360°, and creating a state of realistic candle flame dancing.

The imitation candle further comprises a light source over which a light focusing cover 71 is fitted. Both the light source and the light focusing cover 71 are fixed to a microprocessor circuit board 72. The light-exiting direction of the light source is directed to the imitation flame body 1. The light focusing cover 71 enables the light emitting from the light source to be focused, for facilitating the light to be precisely projected onto the imitation flame body 1 that has a small area.

The light source is an LED light source 7. The LED light source 7 has soft light, good light condensation ability, is easily and precisely projected on the imitation flame body 1 having a small area, has a low power consumption, does not generate too much heat or cause damage to the housing of paraffin wax of the imitation candle and is suitable for being applied to the imitation candle. The light source is electrically connected with the circuit.

The imitation flame body 1 is a leaf-like flame body recessed to one side. The light emitting from the LED light source 7 is projected on the recessed portion of the imitation flame body 1 such that the imitation flame body 1 has a more realistic shape. The light-exiting direction of the light source is directed to the recessed portion of the imitation flame body 1.

The power supply 9 is a battery unit provided at a bottom of the housing 2 for supplying power to the light source. The LED light source 7 used has a low power consumption, and dry batteries used as the power supply are sufficient to power, portable to carry, and easy to be available. A slide switch 10 is provided at a bottom of a battery box, and connected with the circuit, to control on/off of the power of the whole product.

The housing 2 is formed by jointing two semi-cylindrical shells together.

By adopting the above configuration, the flame portion thereof can swing in multiple directions, enhancing the stereoscopic impression of the imitation flame body 1 and achieving higher degree of imitation.

A button switch is provided outside the product (on the external packing box), and a tryout of the product on display could be made by a potential purchaser without taking the product out of the external packing box. The product has a quite simple interface. It can be achieved only by forming an open-circuit contact on a circuitry of the power supply, configuring the two points as external interface terminals, and connecting with the button switch.

A fragrance box 11 is provided at a bottom of the outer shell. The fragrance box 11 has a top opening and a built-in sponge, for adding fragrance in a self-help manner. The fragrance disperses with airflow driven by the fan.

The imitation candle is further provided with a sound control electronic switch which is a capacitive sound pickup 12 for power off the imitation candle and is operable by a user blowing air toward the imitation flame body 1 as if in a real candle situation.

In a preferred embodiment of an imitation candle according to the present invention as shown in FIGS. 1 to 7, an annular top cover 6 is provided at a top of the housing 2, and the imitation flame body 1 extends through the annular top cover 6 to be fixedly connected with the swing rod 4. A pivot ball is provided at an upper portion of the swing rod 4, and a swing rod pivot hole 42 runs through the pivot ball 3. The X pivot shaft 41 runs through the swing rod pivot hole 42 to be pivotally connected with a pivot member 5, wherein the swing rod pivot hole 42 has a bigger diameter than that of the X pivot shaft 41, and the swing rod 4 can freely swing on the X pivot shaft 41 without any restriction.

A pivot support member 51 is provided outside the pivot member 5, and the pivot member 5 and the pivot support member 51 are pivotally connected with each other via the Y pivot shaft 52 inside the pivot support member 51, wherein the Y pivot shaft 52 consists of two minor shafts, and the pivot member 5 is correspondingly provided with two pivot holes 53 for the Y pivot shaft. The X pivot shaft 41 and the Y pivot shaft 52 are on the same horizontal plane.

The swing driving unit is provided below the swing rod 4. The swing rod 4 can swing within 360°, and the imitation flame body 1 is driven by the swing rod 4 to swing within 360° so as to enhance the stereoscopic impression of the imitation flame body 1 of the imitation candle.

Figure 6:
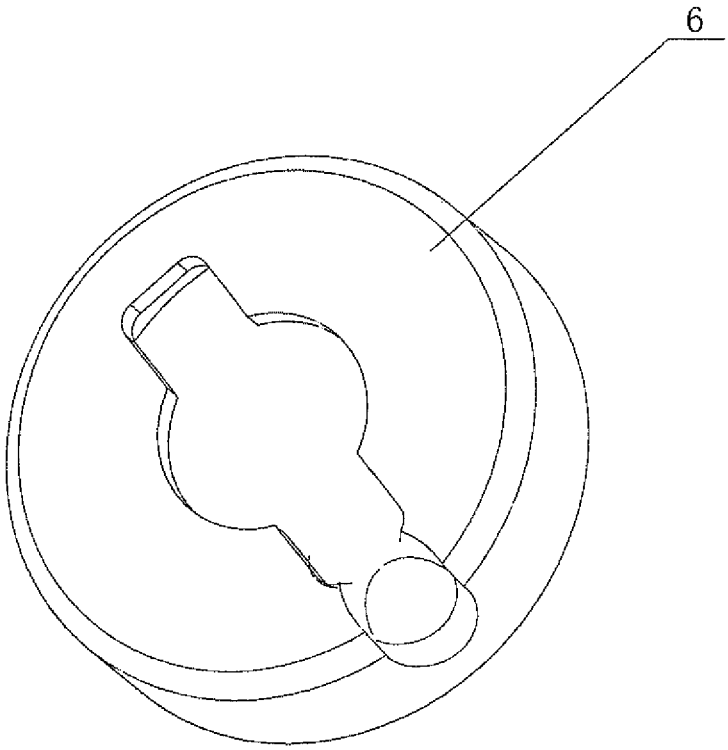
FIG. 6 is a structure schematic view showing an annular top cover of an imitation candle of the present invention.
Figure 7:
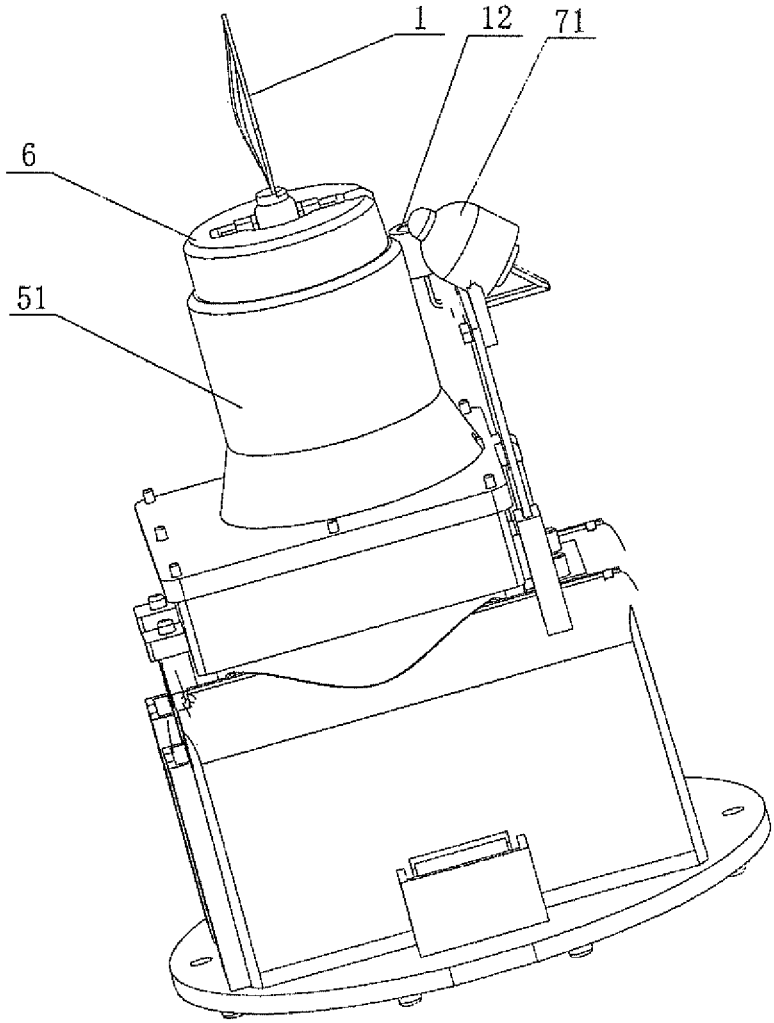
FIG. 7 is an assembled schematic view of an embodiment of an imitation candle according to the present invention.

With reference to FIG. 6, the annular top cover 6 is provided with a light source light penetrating hole at its side.

By adopting the configuration above, the imitation flame body 1 thereof can swing within 360°, enhancing the stereoscopic impression of the imitation flame body 1 and achieving higher imitation degree.

In a specific embodiment, the imitation candle comprises a housing 2, an imitation flame body 1 provided at a top of the housing 2, a light source 7 adapted to emit light onto the imitation flame body 1, a swing motion device, and an air blowing device.

The swing motion device comprises the swing driving unit operationally coupled to the passive swing unit that is configured to allow the imitation flame body 1 to pivot horizontally about only one or at least one of the X axis and the Y axis.

In one main aspect, as shown in FIGS. 1 to 7, the swing driving unit comprises a wind driven pendulum member that takes the form of a wind driven bowl 8 fixedly connected with a lower portion of the swing rod 4 that has an upper portion fixedly connected to the lower portion of the imitation flame body 1. The wind driven bowl 8 is adapted to receive blowing air and has an air discharge hole 81. The air blowing device being a fan 82 is provided below the wind driven bowl 8 and is adapted to blow air toward the wind driven pendulum bowl member causing the wind driven pendulum bowl member to swing. The swing of the wind driven bowl 8 would also cause the imitation flame body to pivot or swing. In particular, an air outlet of the fan 82 is positioned rightly opposite to the wind driven bowl 8. Wind blowing out from the air outlet of the fan 82 wafts the wind driven bowl 8, the wind driven bowl 8 drives the swing rod 4 to swing, and then the swing rod 4 drives the imitation flame body 1 to pivot and swing.

The wind driven bowl 8 configured as a pendulum member is forced to be restored by its own gravity, which causes the swing rod 4 to be restored, and the swing rod 4 drives the imitation flame body 1 to be restored. As a result, the imitation flame body 1 is swinging, restored, swinging again and restored again, which imitates or simulates a real candle flame visually.

The wind driven bowl has an air discharge hole 81. Without the air discharge hole 81, the wind driven bowl 8 may be blown up by the wind and the swing rod 4 might get stuck against the annular top cover 6, resulting in the whole swing motion device incapable of swinging and the imitation flame body 1 incapable of swinging, and affecting normal operation of the imitation candle. The air discharge hole 81 allow air to be discharged therefrom, then the wind driven bowl 8 returns back, allowing the swing motion device to swing normally.

Figure 4A:
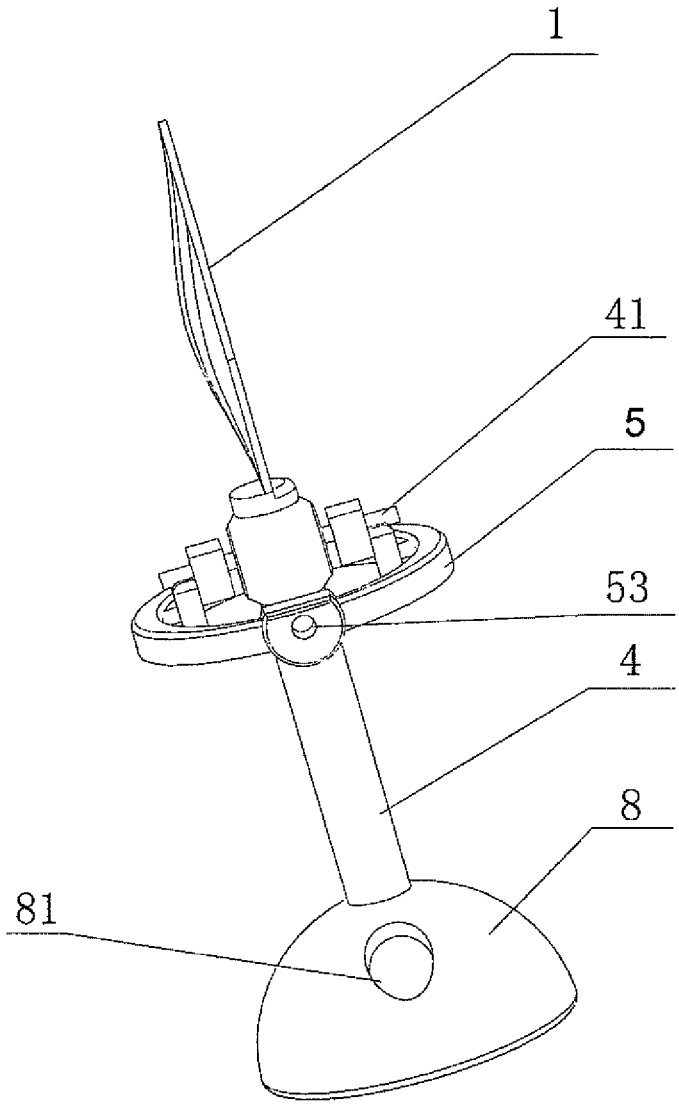
FIG. 4A is a structure schematic view showing a swing motion device of an imitation candle of the present invention.
Figure 4B:
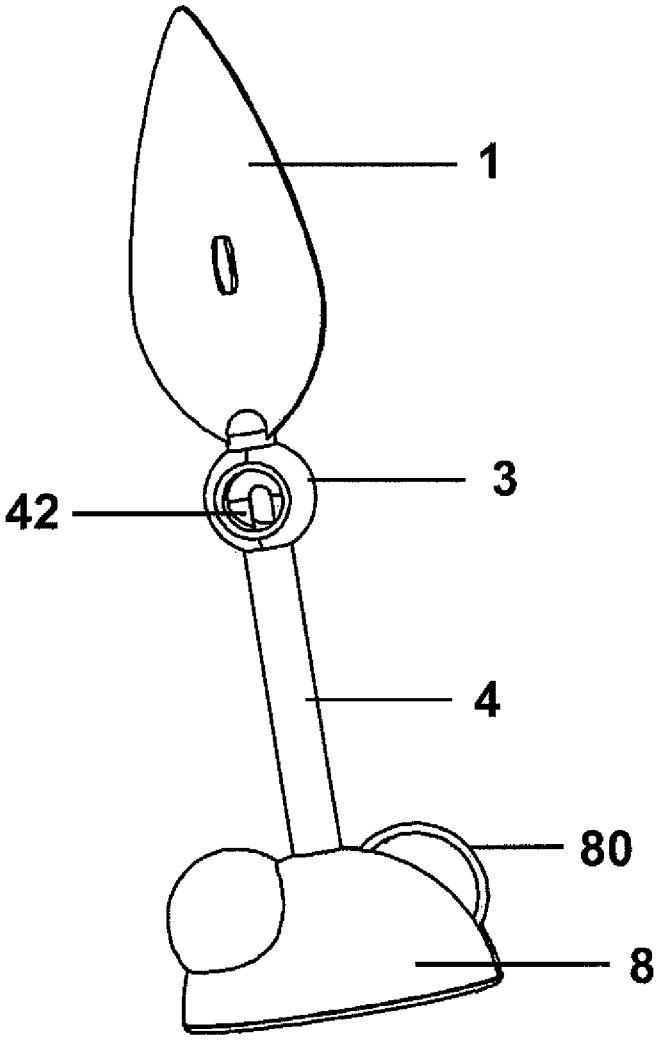
FIGS. 4B and 4C are structure schematic views showing an air discharge direction hood on a wind driven bowl of an imitation candle of the present invention.
Figure 4C:
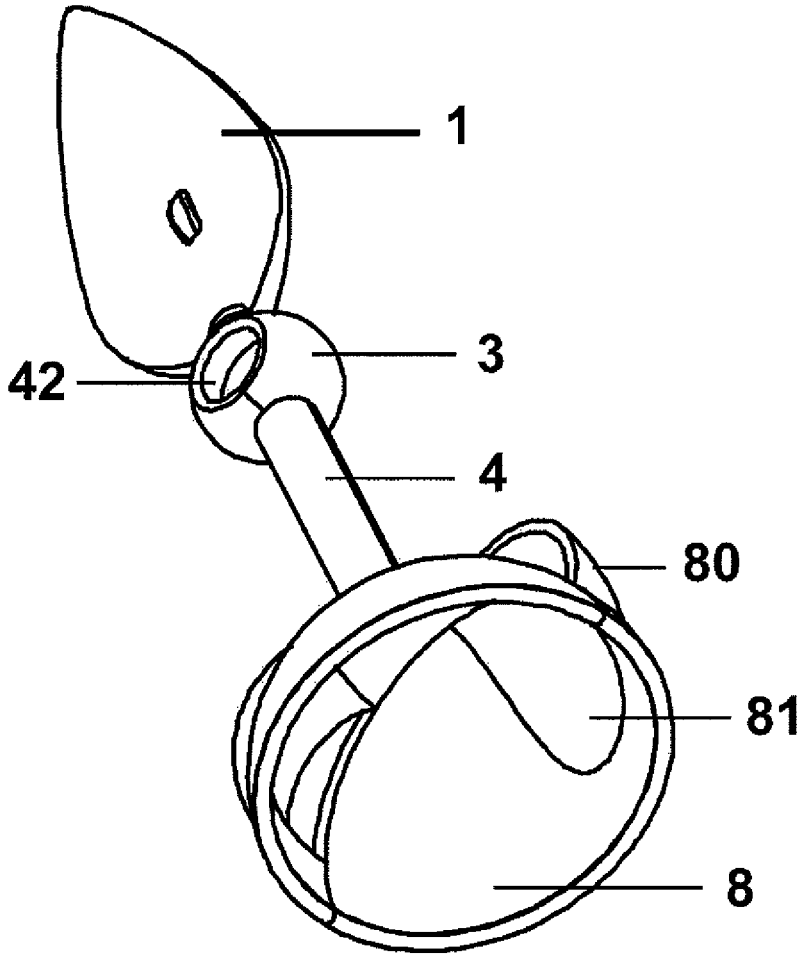
Figure 5:
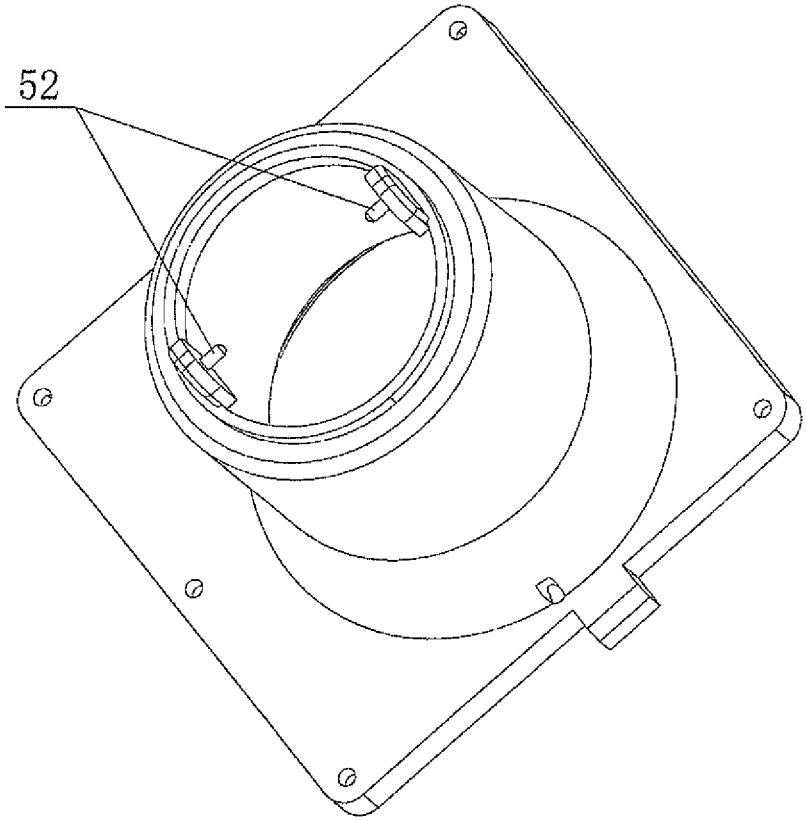
FIG. 5 is a structure schematic view showing a pivot support member of an imitation candle of the present invention.

In FIGS. 4B and 4C, an improved wind driven bowl 8, shown facing downward, is shown. The air discharge hole 81 is provided with an air discharge direction guide, preferably in the form of a hood 80 attached to outside the wind driven bowl 8. The air discharge direction hood 80 may serve a number of benefits. It may direct the flow of air received by the wind driven bowl 8 and provide a more stable swing motion. Further, as it may catch more air while allowing the air to be discharged, it may provide additional lift to swing the wind driven bowl 8 more easily.

It is also contemplated that the microprocessor circuit board may be adapted to control intensity of light emitted from the light source or LED light 7 and or intensity of air flown from the air blowing device or fan 82. For example, by varying the speed of the fan, a better degree of imitation or simulation of the candle could be achieved.

A last, it should be indicated that the above embodiments and features as described are merely for illustrating the technical solutions and various aspects of the present invention without limiting the scope of protection of the present invention. Although the present invention is described in detail with reference to preferable embodiments and features as shown in the accompanying drawings, those skilled in the art should understand and appreciate that modifications or equivalent substitutions may be made to the technical solutions of the present invention without departing from the spirit and scope of the technical solutions of the present invention.

Having described the invention, the following is claimed:

1. An imitation candle, comprising a housing, an imitation flame body provided at a top of said housing, a light source adapted to emit light onto said imitation flame body, a swing motion device, and an air blowing device, characterized in that a lower portion of said imitation flame body is connected with said swing motion device, said swing motion device is configured to allow said imitation flame body to pivot horizontally about at least one of a X axis and a Y axis, and comprises a wind driven pendulum member, and said air blowing device is adapted to blow air toward said wind driven pendulum member causing said wind driven pendulum member to swing as well as said imitation flame body to pivot.

2. An imitation candle according to claim 1, characterized in that the wind driven pendulum member is a wind driven bowl adapted to receive blowing air, and said wind driven bowl has an air discharge hole.

3. An imitation candle according to claim 2, characterized in that the air discharge hole is provided with an air discharge direction guide, preferably in the form of a hood attached to outside the wind driven bowl.

4. An imitation candle according to claim 1, characterized in that the wind driven pendulum member is fixedly connected to a lower portion of a swing rod, and an upper portion of said swing rod is fixedly connected to the lower portion of the imitation flame body.

5. An imitation candle according to claim 1, characterized in that the swing motion device comprises a swing driving unit and a passive swing unit, the swing driving unit being operationally coupled to the passive swing unit, and wherein the swing driving unit comprises the wind driven pendulum member and the passive swing unit comprises at least one of a X pivot shaft and a Y pivot shaft arranged horizontally and perpendicular to each other such that the imitation flame body is allowed to pivot horizontally about at least one of the X axis and the Y axis.

6. An imitation candle according to claim 5, characterized in that the imitation candle further comprises an annular top cover, a swing rod, a pivot member, and a pivot support member, wherein said annular top cover is provided at the top of the housing, the lower portion of the imitation flame body extends through said annular top cover and is fixedly connected to an upper portion of said swing rod, a swing rod pivot hole is provided at said upper portion of said swing rod, the X pivot shaft runs through said swing rod pivot hole to be pivotally connected with said pivot member, said pivot support member is provided outside said pivot member, said pivot member and said pivot support member are pivotally connected via the Y pivot shaft provided inside said pivot support member, said pivot member is correspondingly provided with pivot holes for the Y pivot shaft, the X pivot shaft and the Y pivot shaft are arranged on the same horizontal plane, and the swing driving unit is provided at a lower portion of said swing rod.

7. An imitation candle according to claim 6, characterized in that a pivot ball is provided at a top of the swing rod, and the swing rod pivot hole runs through said pivot ball.

8. An imitation candle according to claim 6, characterized in that the annular top cover is provided with a light penetrating hole for the light source.

9. An imitation candle according to claim 8, characterized in that a light focusing cover is fitted over the light source.

10. An imitation candle according claim 2, characterized in that the air blowing device is a fan provided below the wind driven bowl, and an air outlet of said fan is positioned rightly opposite the wind driven bowl.

11. An imitation candle according to claim 4, characterized in that the imitation flame body is recessed to one side.

12. An imitation candle according to claim 4, characterized in that a microprocessor circuit board and a power supply are provided inside the housing, and said microprocessor circuit board is adapted to control intensity of light from the light source and intensity of air from the air blowing device.

13. An imitation candle according to claim 12, characterized in that the power supply is a battery unit provided at a bottom of the housing, and a slide power on/off switch is provided in a circuitry of the power supply.

14. An imitation candle according to claim 12, characterized in that the imitation candle further comprises a sound control power off switch operable by a user blowing air toward the imitation flame body.

15. An imitation candle according to claim 12, characterized in that a fragrance box is provided inside the housing.

* * * * *